United States Patent [19]

Northcutt

[11] Patent Number: 5,076,644

[45] Date of Patent: Dec. 31, 1991

[54] RECLINING ELEVATOR CHAIR

[75] Inventor: B. Guy Northcutt, St. Louis, Mo.

[73] Assignee: El Lyn Metal Manufacturing, Inc., Campbell, Mo.

[21] Appl. No.: 567,947

[22] Filed: Aug. 15, 1990

[51] Int. Cl.[5] ..... A47C 1/02

[52] U.S. Cl. ..... 297/330; 297/DIG. 10; 297/71; 79/405; 79/625

[58] Field of Search ..... 297/345, 330, DIG. 10, 297/347; 74/625, 405

[56] References Cited

U.S. PATENT DOCUMENTS

| | | | |
|---|---|---|---|
| 4,007,960 | 2/1977 | Gaffney | 297/DIG. 10 |
| 4,137,796 | 2/1979 | Bostrom | 74/625 |
| 4,257,285 | 3/1981 | Whitehouse et al. | 74/405 |
| 4,545,084 | 10/1985 | Peterson | 74/625 X |
| 4,676,122 | 6/1987 | Szabo et al. | 74/625 |
| 4,852,939 | 8/1989 | Krauska | 297/71 |
| 4,854,188 | 8/1989 | Griffiths | 74/625 |

*Primary Examiner*—Peter A. Aschenbrenner
*Attorney, Agent, or Firm*—Grace J. Fishel

[57] ABSTRACT

A reclining elevator chair having a power ram operably connected to both a recliner actuator means for moving a seat-footrest assembly between upright and recline positions in a first mode of operation and an elevator lift means for lifting and tilting the seat-footrest assembly to assist exit from the chair in a second mode of operation. The power ram has a base end and a screw end, the base end is detachably connected to the frame of the chair and the screw end is attached to a crank arm operationally connected to both the recliner actuator means and the elevator lift means. The base end of the power ram can be re-engaged with the frame without loss of synchrony between the power ram and the recliner actuator means and the elevator lift means.

10 Claims, 4 Drawing Sheets

RECLINING ELEVATOR CHAIR

This invention relates to a reclining elevator chair connected to a power ram for reclining the chair in a first mode of operation and for lifting the seat of the chair in a second mode of operation with a mechanism for disengaging the power ram at any time during the first mode of operation to permit manual return of the chair to upright position and then to facilitate re-engagement of the power ram without loss of synchrony.

BACKGROUND OF THE INVENTION

In general, a reclining elevator chair such as described in U.S. Pat. No. 4,007,960 to Gaffney includes a frame, a seat-footrest assembly, a recliner actuator means for moving the seat-footrest assembly between upright and recline positions and an elevator lift means for lifting and tilting the seat-footrest assembly to assist exit from the chair. A power ram is mounted on the frame and is operably connected to both the recliner actuator means and the elevator lift means for sequentially actuating the recliner actuator means in a first mode of operation and for actuating the elevator lift means in a second mode of operation.

If the power ram malfunctions or there is an interruption in the power supply while the chair is in a recline position, it is quite difficult, and even dangerous for an occupant to get out of the chair. This is particularly true if the occupant is aged or infirm. On the other hand, if the malfunction or loss of power occurs when the chair is in upright position or when the seat is elevated, the occupant can safely exit the chair.

SUMMARY OF THE INVENTION

A reclining elevator chair has a frame, a seat-footrest assembly, a recliner actuator means for moving the seat-footrest assembly between upright and recline positions and an elevator lift means for lifting and tilting the seat-footrest assembly to assist exit from the chair. A power ram is detachably connected to the frame and is operably connected to both the recliner actuator means and the elevator lift means for sequentially actuating the recliner actuator means in first mode of operation and for actuating the elevator lift means in a second mode of operation. A means is attached to the frame for disengaging the power ram from the frame at any time during the first mode of operation. The means for disengaging the power ram is operable by the occupant of the chair so that the occupant can manually actuate the recliner actuator means independent of the power ram to move the seat-footrest assembly from any recline position to upright position. The means for disengaging the power ram then facilitates re-engagement of the power ram to the frame without loss of synchrony with the recliner actuator means and the elevator lift means.

BRIEF DESCRIPTION OF THE DRAWINGS

In the accompanying drawings, in which one of various possible embodiments of the invention is illustrated, corresponding reference characters refer to corresponding parts throughout the several views of the drawings and in which.

DETAILED DESCRIPTION OF THE INVENTION

Figure 1:
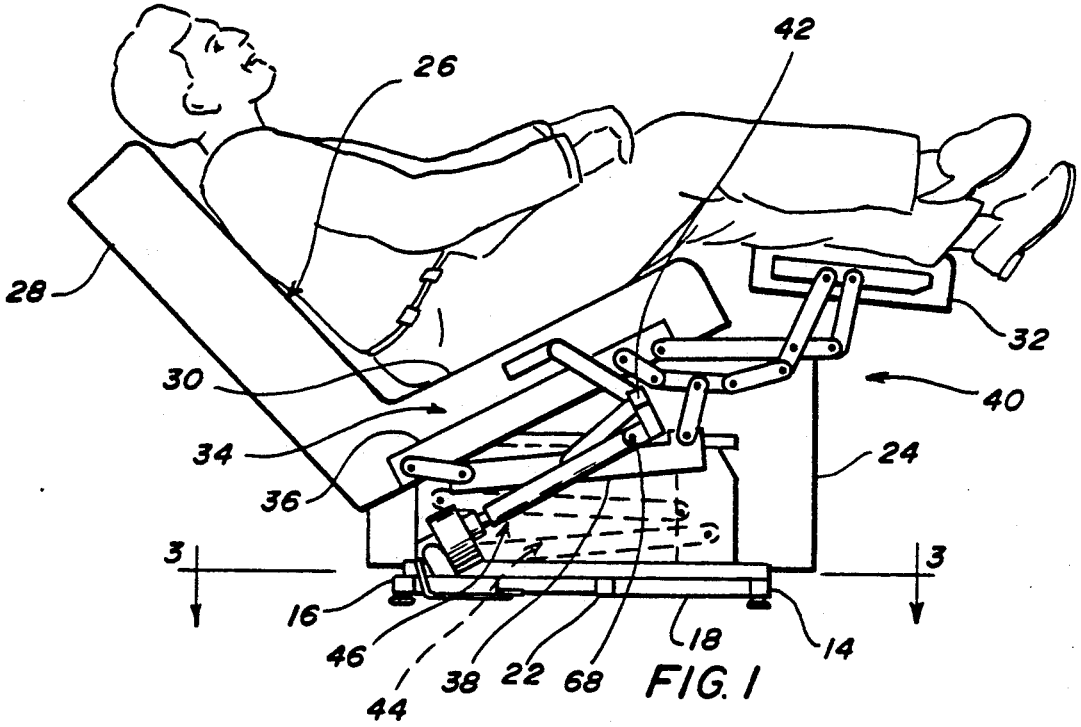
FIG. 1 is a cross section of a reclining elevator chair with the seat-footrest assembly in recline position and with the elevator lift shown in dotted lines.
Figure 3:
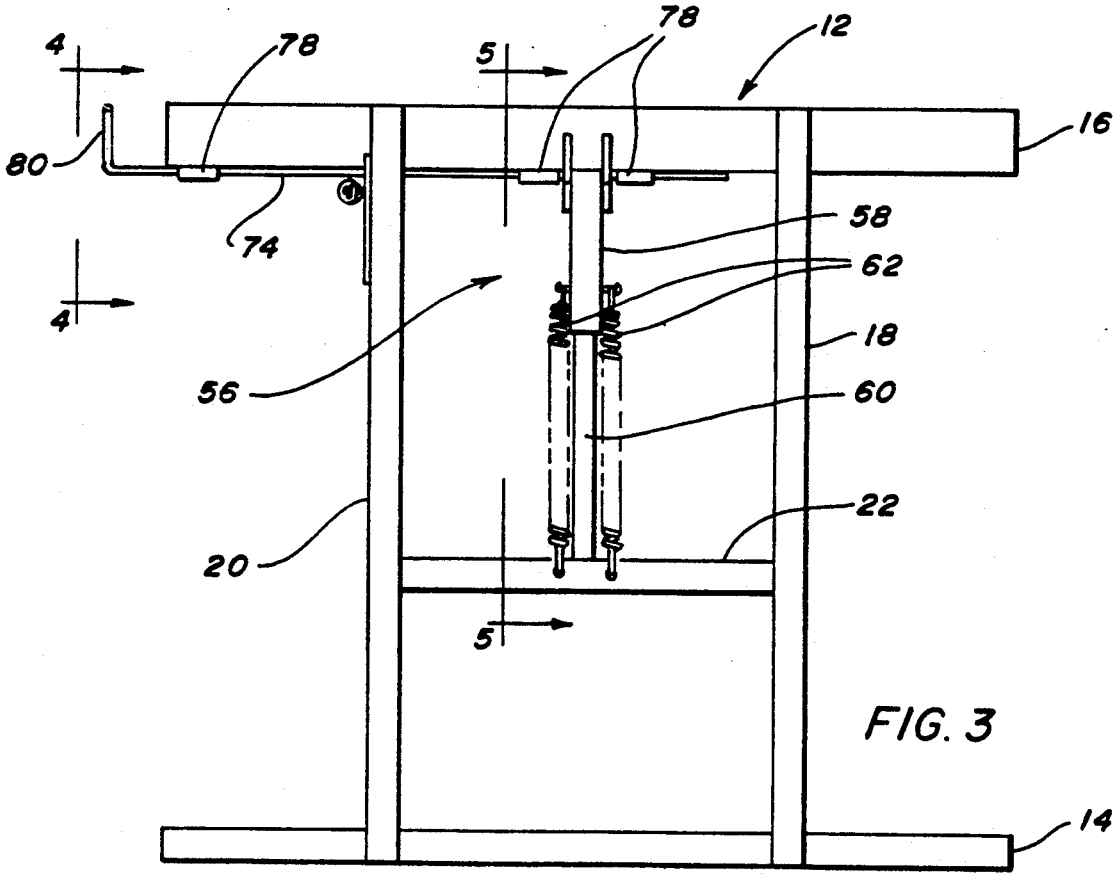
FIG. 3 is a plan view along line 3—3 in FIG. 1.

A reclining elevator chair 10 in accordance with the present invention is built on a frame 12. Frame 12 includes front and rear stretchers 14 and 16 interconnecting left and right side rails 18 and 20, respectively. A brace 22 interconnects side rails 18 and 20 intermediate their ends. Stretchers 14 and 16, side rails 18 and 20 and brace 22 are preferably made of hollow rectangular steel and are welded together to form a sturdy base for the chair.

Chair 10 has sides 24 and a seat-footrest assembly 26 supported by frame 12. Seat-footrest assembly 26 is attached to sides 24 and comprises a back 28, a seat 30 and a footrest 32. Seat-footrest assembly 26 is movable with respect to sides 24 by a recliner actuator means 34. Recliner actuator means 34 are provided on opposite sides of seat 30 and include a pair of braces 36 and 38 and a linkage mechanism 40 Braces 36 are attached to opposite side edges of seat 30 and braces 38 are attached to sides 24. Braces 36 and 38 and footrest 32 are operationally connected to a crank arm 42 by linkage mechanism 40 which moves seat-footrest assembly 26 between upright and recline positions in a manner well known to the art.

Elevator lift means 44 (such as described in the above-mentioned U.S. Pat. No. 4,007,960) are generally indicted in dotted lines in FIGS. 1 and 2. Elevator lift means 44, along with recliner actuator means 34, are operationally connected to crank arm 42. The details of elevator lift means 44 are omitted from the drawings for the sake of clarity and because they are not necessary for understanding the invention.

An extensible and retractable power ram 46 is detachably connected to frame 12 and operably connected to both recliner actuator means 34 and elevator lift means 44 by crank arm 42. Power ram 46 can be a hydraulic ram, pneumatic ram or an electric motor ram. In the illustrated embodiment, an electric motor-driven ram is shown. The ram comprises a power transfer housing 48 threadedly engaged on a power screw 50. Power screw 50 is driven through a speed reducing gearing and drive means 52 by a motor 54. Motor 54 can be controlled for rotation in either direction to extend or retract power ram 46 at will by means of a switch (not shown) preferably in reach of the occupant of the chair.

One end (illustrated as the base end) of power ram 46 is detachably connected to frame 12 at the center of rear stretcher 16 with a means 56 for disengaging the ram attached to the frame. The other end (illustrated as the screw end) of power ram 46 is attached to crank arm 42. In the illustrated embodiment, means 56 for disengaging the ram comprises a slide 58 which reciprocates on a track 60 running between front stretcher 14 and brace 22. Resilient biasing means 62 are connected to front stretcher 14 and slide 58 thereby normally urging slide 58 forwardly on track 60. A latching means 64 locks slide 58 against rear stretcher 16. Power ram 46 is pivotally connected to slide 58 and crank arm 42 with pivot pins 66 and 68, respectively.

Latching means 64 includes an arm 70 which is urged into latching engagement with slide 58 by a resilient biasing means 72. As shown in the drawings, one end of latching arm 70 is connected to a pintle 74 and the other end terminates in a stop 76. Pintle 74 is journaled in knuckles 78 on rear stretcher 16 and terminates in a handle 80 within reach of the occupant of the chair. Stop 76 is urged into latching engagement with slide 58 by resilient biasing means 72 whereby means 56 for disengaging power ram 46 detachably connects the ram to frame 12.

Figure 2:
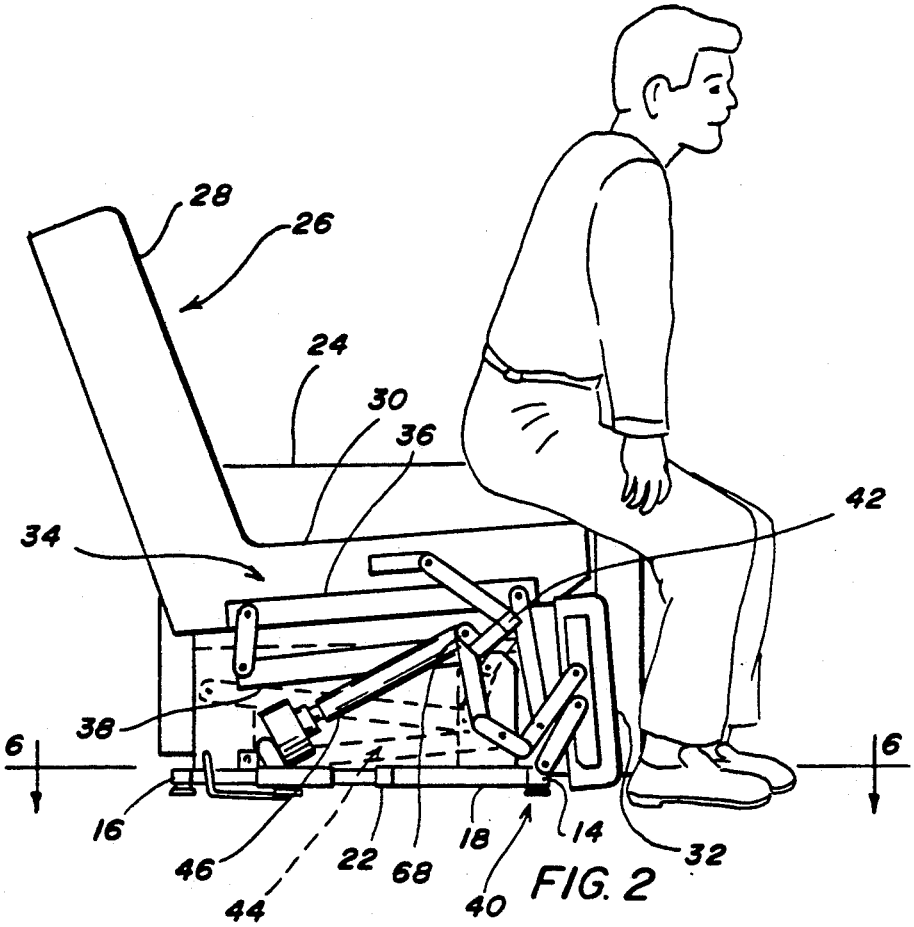
FIG. 2 is a cross section similar to FIG. 1 with the power ram disengaged from the frame so that the occupant can manually return the chair to upright position.
Figure 6:
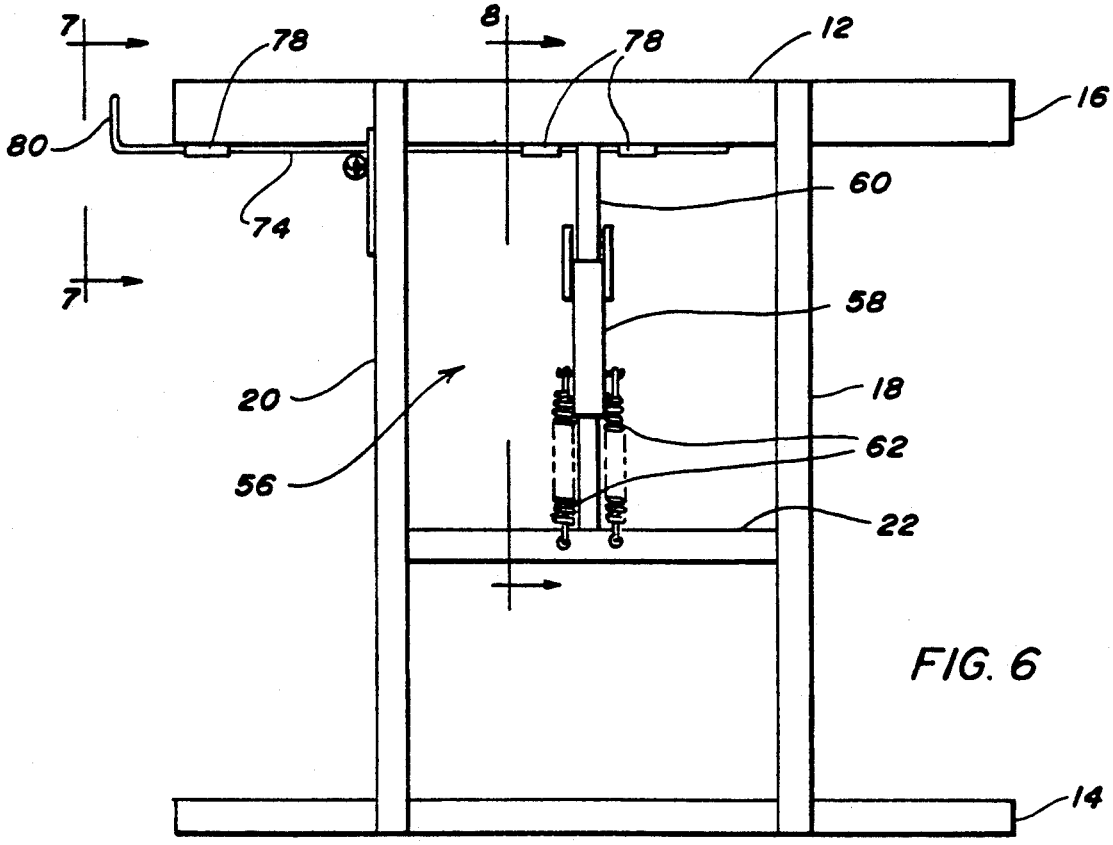
FIG. 6 is a plan view along line 6—6 in FIG. 2.
Figure 4:
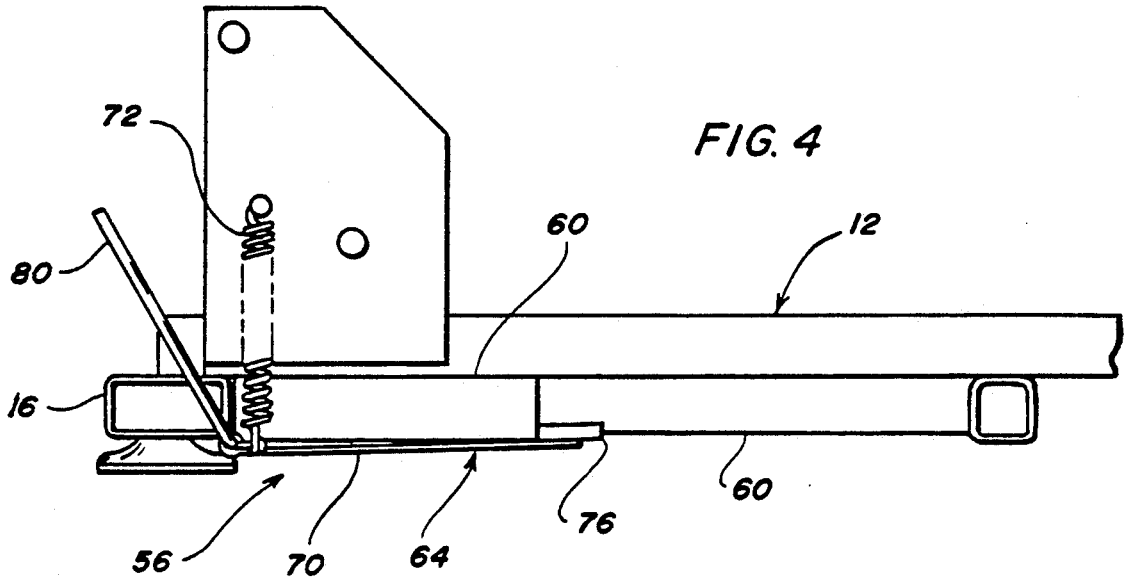
FIG. 4 is a fragmentary elevation along line 4—4 in FIG. 3.
Figure 7:
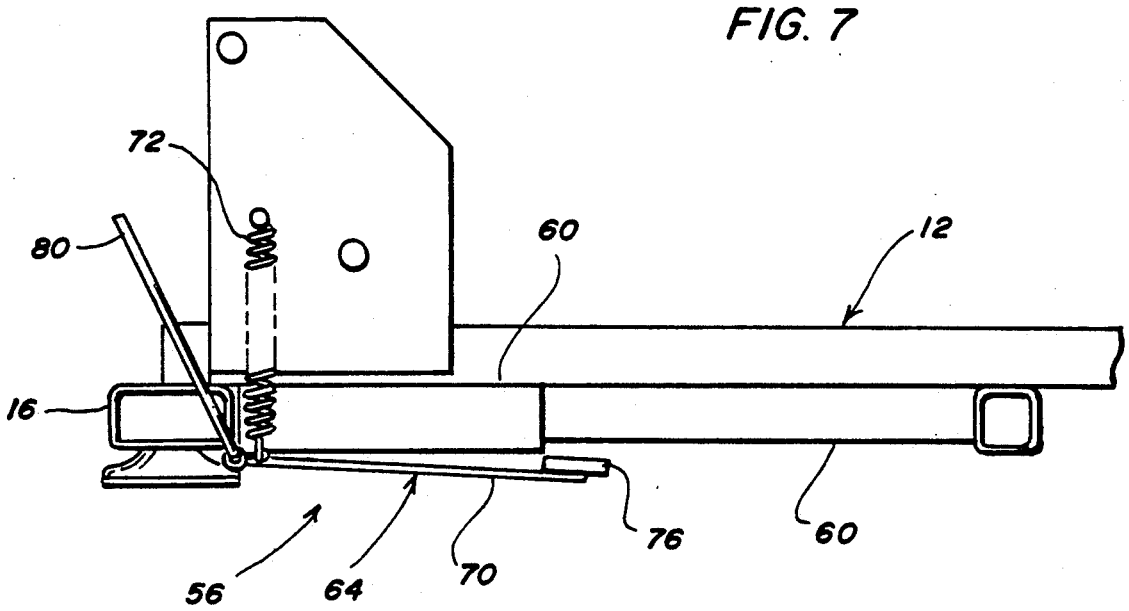
FIG. 7 is a fragmentary elevation along line 7—7 in FIG. 6.
Figure 5:
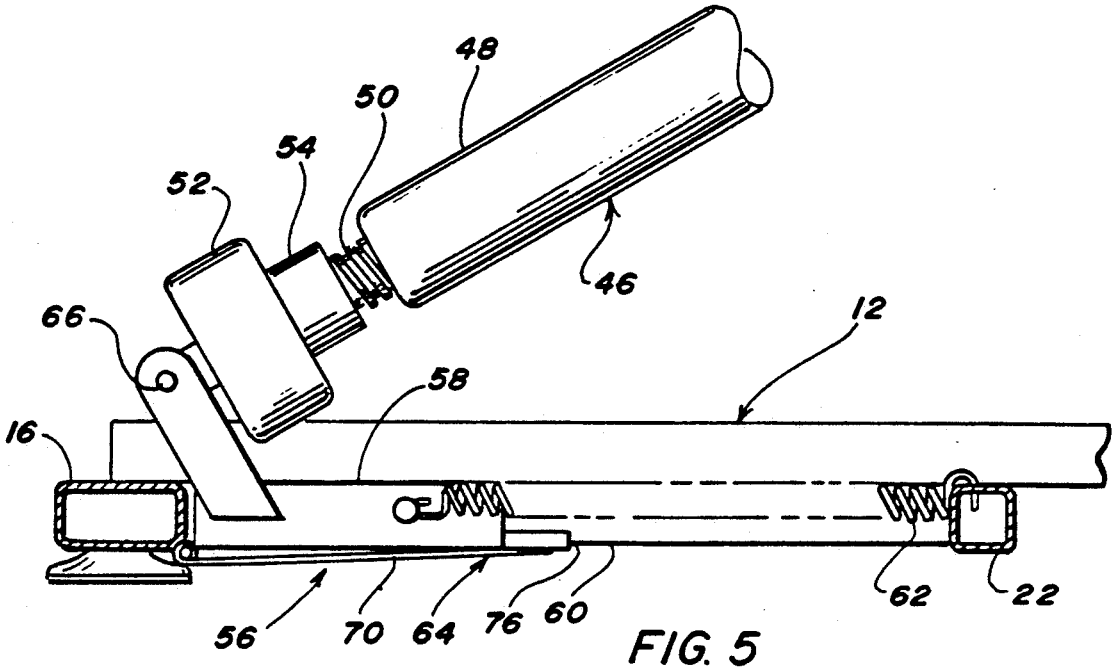
FIG. 5 fragmentary cross section along line 5—5 in FIG. 3.
Figure 8:
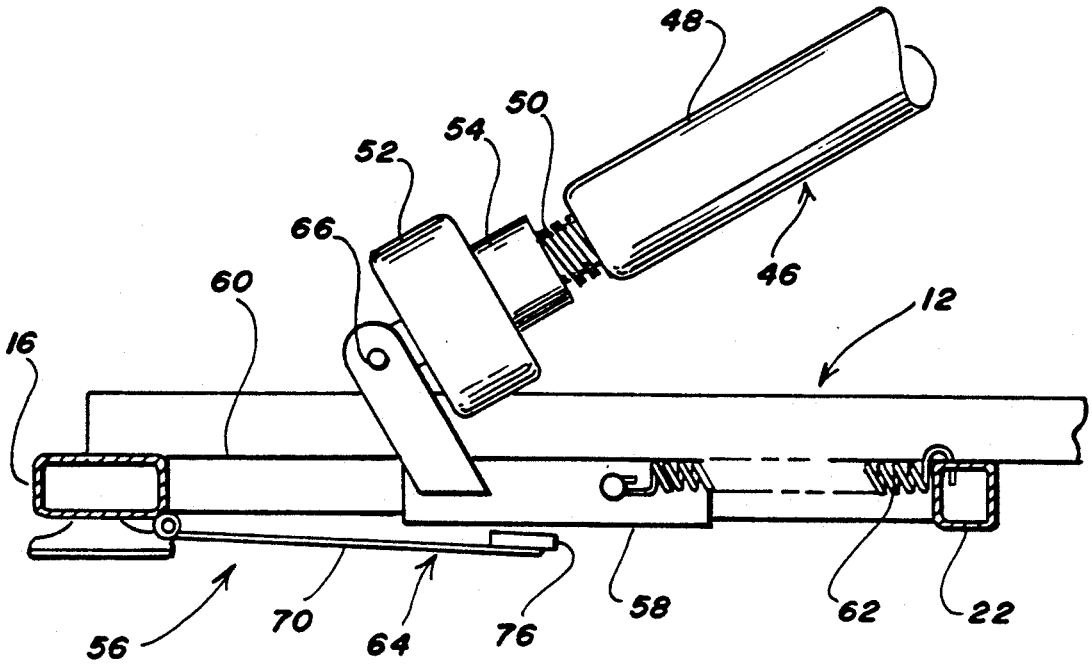
FIG. 8 is a fragmentary cross section along line 8—8 in FIG. 6.

Operation of reclining elevator chair 10 can now best be understood by referring to FIGS. 1 and 2 of the drawings. In normal use, power ram 46 sequentially actuates recliner actuator means 34 in a first mode of operation and elevator lift means 44 in a second mode of operation. During the first mode of operation, retraction of power ram 46 causes crank arm 42 to move seat-footrest assembly 26 from upright to recline position. Extension of power ram 46 causes seat-footrest assembly 26 to return to upright position. Further tension of power ram 46 actuates elevator lift means 44 in a second mode of operation. As illustrated, retraction and extension of power ram 46 is accomplished by rotating power screw 50 in a direction such that power transfer housing 48 is threadedly drawn up and down on screw 50.

If power ram 46 malfunctions or there is an interruption of the power supply while the chair is in any recline position (illustrated as full recline in FIG. 1), the occupant of the chair can return it to upright condition manually. This is accomplished by means 56 which disengage ram 46 from connection to frame 12, allowing the occupant to move seat-footrest assembly 26. As seat-footrest assembly 26 is brought into upright position, ram 46 follows crank arm 42 to which it remains operably connected by pivot pin 68. More particularly, when the occupant presses handle 80, pintle 74 rotates releasing latching means 64 and allowing slide 58 to move on track 60 carrying with it the base of ram 46. With the ram disengaged at one end, recliner actuator means 34 can be manually operated and the chair brought into upright position.

Power ram 46 can be readily re-engaged with frame 12 either by manually operating the chair to the previous recline position or by power extending ram 46. In either case, slide 58 is pushed along track 60 until it is latched by means 64 against rear stretcher 16. Re-engagement of ram 46 with frame 12 results in no loss of synchrony between the ram and recliner actuator means 34 and elevator lift means 44 for moving the seat-footrest assembly between upright and recline positions and for lifting and tilting the seat-footrest assembly to assist exit from the chair.

In view of the above, it will be seen that the several objects of the invention are achieved and other advantageous results attained. As various changes could be made in the above constructions without departing from the scope of the invention, it is intended that all matter contained in the above description or shown in the accompanying drawings shall e interpreted as illustrative and not in a limiting sense.

What is claimed:

1. A reclining elevator chair having a frame, a seat-footrest assembly between upright and means for moving the seat-footrest assembly between upright and recline positions, an elevator lift means for lifting and tilting the seat-footrest assembly to assist exit from the chair, a power ram detachably connected to the frame and operably connected to both the recliner actuator means and the elevator lift means for sequentially actuating the recliner actuator means in a first mode of operation and for actuating the elevator lift means in a second mode of operation, and a means for disengaging the power ram from the frame at any time during the first mode of operation, said means for disengaging the power ram operable by the occupant of the chair so that the occupant can manually actuate the recliner actuator means independent of the power ram to move the seat-footrest assembly to upright position and said means for disengaging the power ram further facilitating automatic re-engagement of the power ram to the frame without loss of synchrony with the recliner actuator means and the elevator lift means when the power ram is placed in a position that brings the seat-footrest assembly into upright position when the power ram is engaged to the frame.

2. The chair of claim 1 wherein the power ram is an electric power ram and has a base end and a screw end and wherein the means for disengaging the power ram comprises a slide to which the base end of the electric power ram is attached, said slide reciprocating on a track and detachably connected to the frame by a latching means.

3. The chair of claim 2 wherein the latching means comprises an arm with a stop, said stop resiliently biased into latching engagement with the slide.

4. The chair of claim 3 wherein the arm is mounted on a pintle pivotally attached to the frame, said pintle ending with a handle within each of the occupant of the chair.

5. The chair of claim 4 wherein the screw end of the electric power ram is operably connected to the recliner actuator means and the elevator lift means by a crank arm.

6. The chair of claim 5 wherein the electric power ram has a power transfer housing threadedly engaged in a power screw, said power screw driven for rotation in either directed by a motor.

7. A reclining elevator chair having a frame with front and rear stretchers interconnecting right and left side rails, a recliner actuator means for moving the seat-footrest assembly between upright and recline positions, an elevator lift means for lifting and tilting the seat-footrest assembly to assist exit from the chair, an electric motor-driven ram with a power transfer housing threadedly engaged on a power screw, said power screw driven for rotation in either direction by a motor, said electric motor-driven ram detachably connected to the rear stretcher of the frame and operably connected to both the recliner actuator means and the elevator lift means for sequentially actuating the recliner actuator means in a first mode of operation and for actuating the elevator lift means in a second mode of operation, and a means for disengaging the electric motor-driven ram from the rear stretcher at any time during the first mode of operation, said means for disengaging the electric motor-driven ram operable by the occupant of the chair so that the occupant can manually actuate the recliner actuator means independent of the electric motor-driven ram to move the seat-footrest assembly to upright position and said means for disengaging the electric motor-driven ram facilitating re-engagement of the electric motor-driven ram to the rear stretcher without loss of synchrony with the recliner actuator means and the elevator lift means, said electric motor-driven ram having a base end and a screw end, said means for disengaging the electric motor-driven ram comprising a side to which the base end of the electric motor-driven ram is attached, said slide reciprocating on a track and detachably connected to the rear stretcher by a latching means.

8. The chair of claim 7 wherein the slide is resiliently biased on the track towards the front stretcher.

9. The chair of claim 8 wherein the latching means comprises an arm with a stop, said stop resiliently biased into latching engagement with the slide.

10. The chair of claim 9 wherein the arm is mounted on a pintle pivotally attached to the rear stretcher, said pintle ending with a handle within reach of the occupant of the chair.

* * * * *